US012723371B1

(12) United States Patent
Nonomura et al.

(10) Patent No.: US 12,723,371 B1
(45) Date of Patent: Sep. 1, 2026

(54) OUTPUT CONTROL DEVICE, METHOD AND PROGRAM

(71) Applicant: Takeuchi Mfg. Co., Ltd., Nagano (JP)

(72) Inventors: Kengo Nonomura, Nagano (JP); Takahiro Watanabe, Nagano (JP)

(73) Assignee: Takeuchi Mfg. Co., Ltd., Nagano (JP)

( * ) Notice: Subject to any disclaimer, the term of this patent is extended or adjusted under 35 U.S.C. 154(b) by 0 days.

(21) Appl. No.: 19/253,265

(22) Filed: Jun. 27, 2025

(30) Foreign Application Priority Data

Feb. 28, 2025 (JP) ..... 2025-032067

(51) Int. Cl.
*E02F 9/22* (2006.01)

(52) U.S. Cl.
CPC ..... *E02F 9/2235* (2013.01)

(58) Field of Classification Search
CPC ..... F15B 21/087; F15B 2211/6652; E02F 9/2235
See application file for complete search history.

(56) References Cited

U.S. PATENT DOCUMENTS

2019/0112786 A1* 4/2019 Nishikawa ..... F04B 49/06

FOREIGN PATENT DOCUMENTS

| | | | |
|---|---|---|---|
| EP | 1286057 | A1 | 2/2003 |
| EP | 3521637 | A1 | 8/2019 |
| EP | 4012117 | A1 | 6/2022 |
| JP | H06-108497 | A | 4/1994 |
| JP | H09229005 | A | 9/1997 |

OTHER PUBLICATIONS

Extended European Search Report issued in EP 25185828.8-1009 by the European Patent Office on Dec. 3, 2025.

* cited by examiner

*Primary Examiner* — Abiy Teka
(74) *Attorney, Agent, or Firm* — Studebaker Brackett PLLC

(57) ABSTRACT

An output control device is for adjusting output from a hydraulic fluid discharge device configured to be driven by a power source configured to output with a certain horsepower, and the output control device comprises: a hydraulic pressure acquiring portion configured to acquire a hydraulic pressure detected by a hydraulic pressure detecting device configured to detect a hydraulic pressure of a hydraulic fluid discharged from the hydraulic fluid discharge device; and an output control portion configured to adjust the output from the hydraulic fluid discharge device by adjusting a flow rate of the hydraulic fluid in correspondence with the hydraulic pressure of the hydraulic fluid discharged from the hydraulic fluid discharge device based on the hydraulic pressure acquired by the hydraulic pressure acquiring portion.

6 Claims, 6 Drawing Sheets

OUTPUT CONTROL DEVICE, METHOD AND PROGRAM

CROSS-REFERENCE OF RELATED APPLICATIONS

This application claims the benefit of Japanese Patent Application No. 2025-32067 filed in Japan on Feb. 28, 2025, the contents of which applications are incorporated herein by reference.

FIELD

The present disclosure relates to an output control device, method and program for controlling output from a hydraulic fluid discharge device.

BACKGROUND

In a work vehicle and the like, a hydraulic fluid discharge device is used which is configured to be driven by a power source configured to output with a certain horsepower, and discharge a hydraulic fluid to supply it to a hydraulic driving device. For the hydraulic fluid discharge device, a target horsepower to be output from the hydraulic fluid discharge device is set within the output horsepower from the power source. There is a possibility that the power source stops when a horsepower of output from the hydraulic fluid discharge device, that is, an absorption horsepower thereof exceeds the target horsepower, and so the absorption horsepower of the hydraulic fluid discharge device has to be less than the target horsepower. Therefore, in the hydraulic fluid discharge device, a flow rate is set in correspondence with the hydraulic pressure, and thereby the absorption horsepower of the hydraulic fluid discharge device is made to be less than and closer to the target horsepower. Furthermore, in the case where other driving device is driven by the power source, the target horsepower to be output from the hydraulic fluid discharge device is changed according to a horsepower of output from the other driving device, and so in the hydraulic fluid discharge device, the flow rate set in correspondence with the hydraulic pressure is changed, and thereby the absorption horsepower of the hydraulic fluid discharge device is made to be less than the changed target horsepower. For example, Japanese Patent Publication No. H6-108497 may be mentioned as a prior art document.

SUMMARY

In an aspect of the present disclosure, an output control device is for adjusting output from a hydraulic fluid discharge device configured to be driven by a power source configured to output with a certain horsepower, and the output control device comprises: a hydraulic pressure acquiring portion configured to acquire a hydraulic pressure detected by a hydraulic pressure detecting device configured to detect a hydraulic pressure of a hydraulic fluid discharged from the hydraulic fluid discharge device; and an output control portion configured to adjust the output from the hydraulic fluid discharge device by adjusting a flow rate of the hydraulic fluid in correspondence with the hydraulic pressure of the hydraulic fluid discharged from the hydraulic fluid discharge device based on the hydraulic pressure acquired by the hydraulic pressure acquiring portion.

In another aspect of the present disclosure, an output control method is for adjusting output from a hydraulic fluid discharge device configured to be driven by a power source configured to output with a certain horsepower, and the output control method comprises: a hydraulic pressure acquiring to acquire a hydraulic pressure detected by a hydraulic pressure detecting device configured to detect a hydraulic pressure of a hydraulic fluid discharged from the hydraulic fluid discharge device; and an output controlling to adjust the output from the hydraulic fluid discharge device by adjusting a flow rate of the hydraulic fluid in correspondence with the hydraulic pressure of the hydraulic fluid discharged from the hydraulic fluid discharge device based on the hydraulic pressure acquired by the hydraulic pressure acquiring portion.

In yet another aspect of the present disclosure, a non-transitory tangible storage medium stores an output control program for adjusting output from a hydraulic fluid discharge device configured to be driven by a power source configured to output with a certain horsepower, and the output control program causes a computer to execute: a hydraulic pressure acquiring to acquire a hydraulic pressure detected by a hydraulic pressure detecting device configured to detect a hydraulic pressure of a hydraulic fluid discharged from the hydraulic fluid discharge device; and an output controlling to adjust the output from the hydraulic fluid discharge device by adjusting a flow rate of the hydraulic fluid in correspondence with the hydraulic pressure of the hydraulic fluid discharged from the hydraulic fluid discharge device based on the hydraulic pressure acquired by the hydraulic pressure acquiring portion.

DESCRIPTION OF EMBODIMENTS

An embodiment of the present disclosure will be described below with reference to FIGS. 1 to 4.

Figure 1:
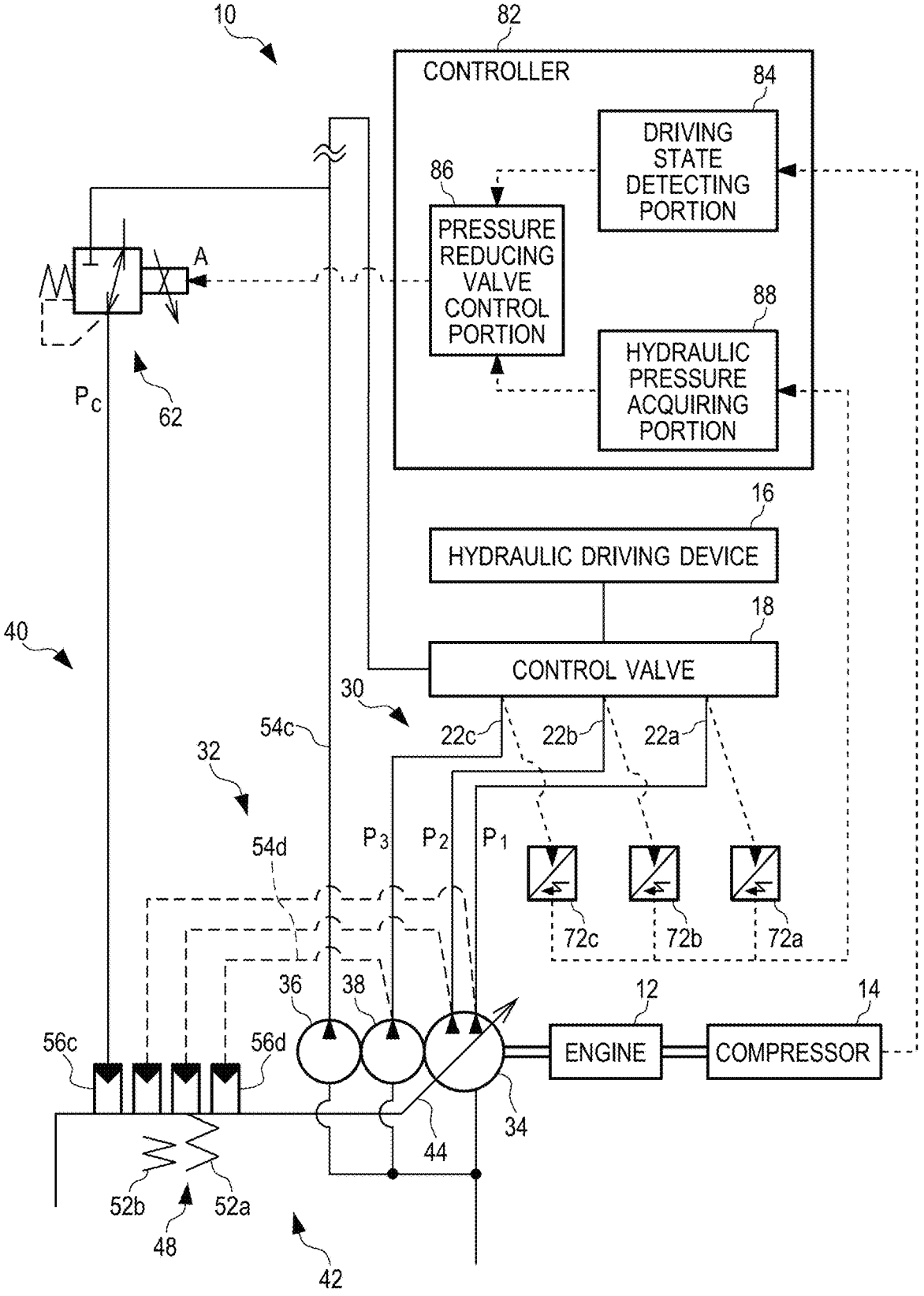
FIG. 1 is a block diagram showing a work vehicle according to an embodiment of the present disclosure.

Referring to FIGS. 1 and 2, a hydraulic excavator 10 as a work vehicle according to the embodiment will be described.

As shown in FIG. 1, the hydraulic excavator 10 includes an engine 12 as a power source, a compressor 14 of an air conditioner as a driving device, a hydraulic fluid supply system 30, and various types of hydraulic driving devices 16. The engine 12 configured to output with a certain horsepower drives the compressor 14 and hydraulic fluid supply system 30, and the hydraulic fluid supplied from the hydraulic fluid supply system 30 drives the various types of hydraulic driving devices 16.

In the present embodiment, the compressor 14 of the air conditioner is driven by the engine 12, but some driving devices may be driven by the engine 12 instead of or in addition to the compressor 14 of the air conditioner.

The hydraulic fluid supply system 30 includes a pump unit 32, an output control system 40, and a control valve 18. The output control system 40 includes a flow rate adjusting mechanism 42 as a flow rate adjusting device, a pressure reducing valve 62 as an output changing device, first to third hydraulic pressure sensors 72*a*, 72*b* and 72*c* as hydraulic pressure detecting devices, and a controller 82 as an output control device.

The pump unit 32 includes a main pump 34 as a first hydraulic fluid discharge device, a sub-pump 38 as a second hydraulic fluid discharge device, and a pilot pump 36. The main pump 34, sub-pump 38, and pilot pump 36 are driven by the engine 12.

The main pump 34 discharges hydraulic fluids whose discharge flow rate Q from first and second discharge outlets are equal to each other. The main pump 34 supplies the hydraulic fluids from the first and second discharge outlets through first and second supply channels 22*a* and 22*b* via the control valve 18 to the various types of hydraulic driving devices 16. For example, the hydraulic fluid is supplied from the first discharge outlet of the main pump 34 to a boom cylinder of a boom, a bucket cylinder of a bucket, and a left traveling motor of a crawler traveling device, and from the second discharge outlet to a right traveling motor of the crawler traveling device, an arm cylinder of an arm, and a service port.

In the case where the engine 12 drives a driving device other than the main pump 34, an output horsepower from the engine 12 has to be also distributed to output from driving device other than the main pump 34, and so the output horsepower which can be distributed to output from the main pump 34 is limited. For the main pump 34, a target horsepower to be output from the main pump 34 is set within the output horsepower from the engine 12. It is a possibility that the engine 12 stalls when a horsepower of the output from the main pump 34, that is, an absorption horsepower thereof exceeds the target horsepower, and so the absorption horsepower of the main pump 34 is made not to exceed the target horsepower.

That is, in the main pump 34, the absorption horsepower is determined by a product of a total hydraulic pressure P of first and second discharge hydraulic pressures $P_1$ and $P_2$ of the hydraulic fluid discharged from the first and second discharge outlets and a discharge flow rate Q of the hydraulic fluid discharged from the first and second discharge outlets. In the main pump 34, the discharge flow rate Q is set in correspondence with the total hydraulic pressure P of the first and second discharge hydraulic pressures $P_1$ and $P_2$ by the flow rate adjusting mechanism 42, and thereby the absorption horsepower of the main pump 34 is made to be less than and close to the target horsepower.

Specifically, the flow rate adjusting mechanism 42 includes a swash plate 44 as a flow rate adjusting member, a bias mechanism 48, a pilot port 56*c*, a channel 54*d*, and a port 56*d*. In the main pump 34, an inclination angle as a position of the swash plate 44 is increased or decreased, and thereby the discharge flow rate Q of the hydraulic fluid discharged from the first and second discharge outlets is increased or decreased. The swash plate 44 is biased in a direction in which the inclination angle increases, that is, the discharge flow rate Q increases, by bias force of the bias mechanism 48. On the other hand, the swash plate 44 is pushed in a direction in which the inclination angle decreases, that is, the discharge flow rate Q of the main pump 34 decreases, by the total hydraulic pressure P of the first and second discharge hydraulic pressures $P_1$ and $P_2$ of the hydraulic fluid discharged from the first and second discharge outlets of the main pump 34. When the total hydraulic pressure P of the first and second discharge hydraulic pressures P1 and P2 increases or decreases, the inclination angle of the swash plate 44 decreases or increases by the hydraulic pressure of the total hydraulic pressure P against the bias force of the bias mechanism 48 or by the bias force of the bias mechanism 48 against the hydraulic pressure of the total hydraulic pressure P, and the flow rate Q of the main pump 34 decreases or increases. The bias force of the bias mechanism 48 is set such that the absorption horsepower of the main pump 34 is less than and close to the target horsepower over assumed entire range of the total hydraulic pressure P.

Figure 2A:
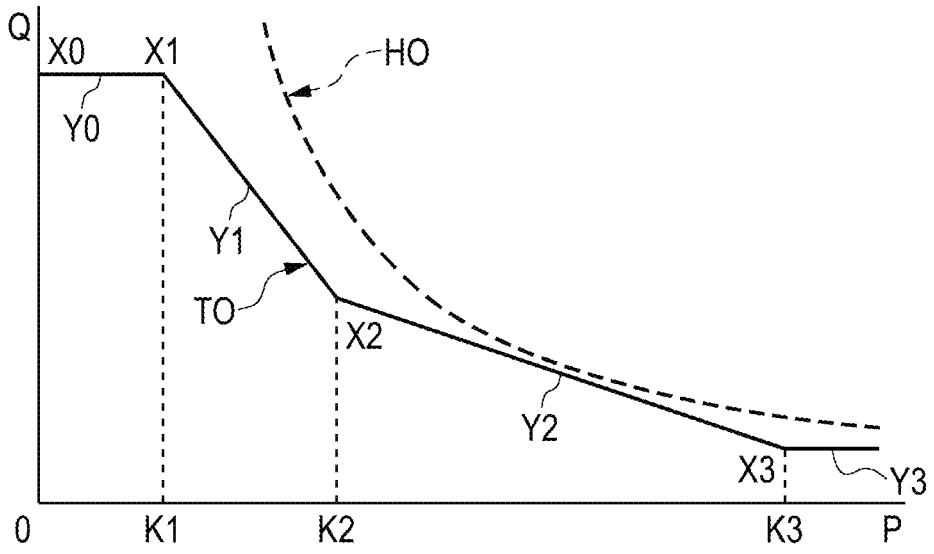
FIGS. 2A-2C are graphical diagrams showing a principle of output control in the embodiment of the present disclosure.

In the present embodiment, as shown in FIG. 2A, the discharge flow rate Q of the main pump 34 is set in correspondence with the total hydraulic pressure P of the first and second discharge hydraulic pressures $P_1$ and $P_2$ according to a characteristic line TO with respect to a target horsepower curve HO of the main pump 34.

That is, the bias mechanism 48 includes first and second elastic members 52*a*, 52*b*. When the total hydraulic pressure P is between zero and a first reference hydraulic pressure K1, the first elastic member 52*a* performs bias, the inclination angle of the swash plate 44 is not increased or decreased by the hydraulic pressure of the total hydraulic pressure P against the bias force of the bias mechanism 48, the inclination angle of the swash plate 44 is maintained at a maximum, and the discharge flow rate Q of the main pump 34 is maintained at a maximum. When the total hydraulic pressure P is between the first reference hydraulic pressure K1 and a second reference hydraulic pressure K2, the first elastic member 52*a* performs bias, the inclination angle of the swash plate 44 is decreased or increased by the hydraulic pressure of the total hydraulic pressure P against the bias force of the first elastic member 52*a* or by the bias force of the first elastic member 52*a* against the hydraulic pressure of the total hydraulic pressure P. When the total hydraulic pressure P is between the second reference hydraulic pressure K2 and a third reference hydraulic pressure K3, the second elastic member 52*b* as well as the first elastic member 52*a* performs bias, the inclination angle of the swash plate 44 is decreased or increased by the hydraulic pressure of the total hydraulic pressure P against the bias force of the first and second elastic members 52*a* and 52*b* or by the bias force of the first and second elastic members 52*a* and 52*b* against the hydraulic pressure of the total hydraulic pressure P, and the discharge flow rate Q of the main pump 34 is decreased or increased. When the total hydraulic pressure P is equal to or more than the third reference hydraulic pressure K3, the inclination angle of the swash plate 44 is maintained at a minimum, and the discharge flow rate Q of the main pump 34 is maintained at a minimum. The bias forces of the first and second elastic members 52*a* and 52*b* of the bias mechanism 48 is set such that the absorption horsepower of the main pump 34 is less than, and follows and close to the target horsepower, over the assumed entire range of the total hydraulic pressure P.

Therefore, as shown in FIG. 2A, points where the total hydraulic pressure P is zero, and first, second and third reference hydraulic pressures K1, K2 and K3 in the characteristic line TO are referred to as a starting point X0, and first, second and third bend points X1, X2 and X3, and a zeroth line segment Y0 from the starting point X0 to the first bend point X1 extends horizontally, a first line segment Y1 from the first bend point X1 to the second bend point X2 descends with a constant slope, and a second line segment Y2 from the second bend point X2 to the third bend point X3 descends with a constant slope less than that of the first line segment Y1, and the third line segment Y3 beyond the third bend point X3 extends horizontally. The characteristic line TO is positioned so as to be below, and follow and close to the target horsepower curve HO over the assumed entire range of the total hydraulic pressure P.

Referring again to FIG. 1, when the air conditioner is driven in the hydraulic excavator 10, the output horsepower from the engine 12 has to be also distributed to the compressor 14 of the air conditioner, and so the output horsepower which can be distributed to the main pump 34 is reduced. Therefore, a horsepower reduction is performed which reduces the target horsepower to be output from the main pump 34, and reduces the absorption horsepower of the main pump 34 according to the reduced target horsepower.

That is, in the main pump 34, the flow control mechanism 42 is operated by the pressure reducing valve 62, and thereby the discharge flow rate Q set in correspondence with the total hydraulic pressure P of the first and second discharge hydraulic pressures $P_1$ and $P_2$ is decreased, and the absorption horsepower of the main pump 34 is made to be less than the reduced target horsepower (hereinafter, also referred to simply as 'target horsepower').

Specifically, the pump unit 32 includes the pilot pump 36. The pilot pump 36 supplies pilot fluid to the pilot port 56*c* of the flow control mechanism 42 of the main pump 34 via the pilot channel 54*c* and the pressure reducing valve 62. The swash plate 44 is pushed in the direction in which the inclination angle decreases, that is, the discharge flow rate Q of the main pump 34 decreases by the hydraulic pressure of the pilot fluid supplied to the pilot port 56*c*. The pressure reducing valve 62 is controlled by the controller 82 as the output control device. In the controller 82, a driving state detecting portion 84 detects a driving state of the compressor 14 of the air conditioner. When the driving state detecting portion 84 detects that the compressor 14 is not being driven, the pressure reducing valve control portion 86 as an output control portion does not supply a control current A to the pressure reducing valve 62 to make the hydraulic pressure of the pilot fluid supplied to the pilot port 56*c* by the pressure reducing valve 62 from the pilot pump 36 zero. When the driving state detecting portion 84 detects that the compressor 14 is being driven, the pressure reducing valve control portion 86 supplies the control current A to the pressure reducing valve 62 to increase the hydraulic pressure of the pilot fluid supplied to the pilot port 56*c* by the pressure reducing valve 62 from the pilot pump 36, decrease the inclination angle of the swash plate 44 against the bias force of the bias mechanism 48, decrease the discharge flow rate Q of main pump 34, and reduce the absorption horsepower of the main pump 34.

Figure 2B:
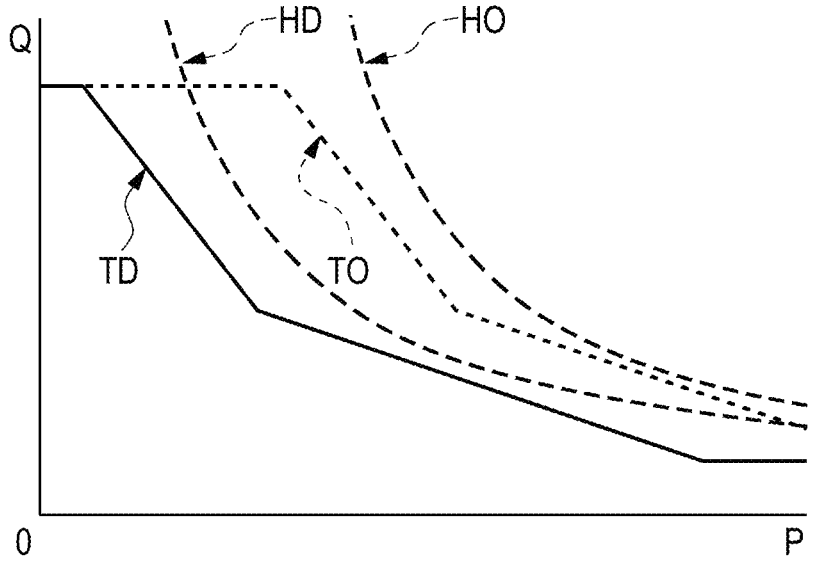

In the present embodiment, as shown in FIG. 2B, the characteristic line TO with respect to the target horsepower curve HO when the compressor 14 of the air conditioner is not being driven is moved to a characteristic line TD on the left side with respect to a target horsepower curve HD reduced from the target horsepower curve HO when the compressor 14 of the air conditioner is being driven.

Here, in the case where the control current A supplied to the pressure reducing valve 62 is constant during the compressor 14 being driven, and in addition, the hydraulic pressure of the pilot fluid supplied to the pilot port 56*c* by the pressure reducing valve 62 is constant, it is needed that the absorption horsepower of the main pump 34 is less than the target horsepower, that is, the characteristic line TD is positioned below the target horsepower curve HD, over the assumed entire range of the total hydraulic pressure P. In this case, the characteristic line TD does not perfectly follow the target horsepower curve HD, and so the main pump 34 outputs with a horsepower lower than the target horsepower even though there is room to increase the discharge flow rate Q of the main pump 34 to increase the horsepower with respect to the target horsepower depending on the total hydraulic pressure P. Therefore, the output horsepower from the engine 12 cannot be effectively utilized to the maximum extent.

Therefore, in the present embodiment, the first and second discharge hydraulic pressures P1 and P2 of the main pump 34 is further detected, and based on the detected total hydraulic pressure P of the first and second discharge hydraulic pressures P1 and P2, the pressure reducing valve 62 is controlled, the flow rate adjusting mechanism 42 is adjusted, the flow rate Q set in correspondence with the total hydraulic pressure P in the main pump 34 is adjusted, and thereby the absorption horsepower of the main pump 34 is adjusted so as to be less than and come close to the target horsepower.

That is, referring again to FIG. 1, the first and second hydraulic pressure sensors 72*a* and 72*b* detect the first and second discharge hydraulic pressures $P_1$ and $P_2$ of the hydraulic fluids discharged from the first and second discharge outlets of the main pump 34 and output to the controller 82. In the controller 82, the hydraulic pressure acquiring portion 88 acquires the detected first and second discharge hydraulic pressures $P_1$ and $P_2$ input from the first and second hydraulic pressure sensors 72*a* and 72*b*, and acquires the total hydraulic pressure P of the detected first and second discharge hydraulic pressures P1 and P2. The pressure reducing valve control portion 86 sets the target horsepower to be output from the main pump 34 within the output horsepower from the engine 12 according to a horsepower of output from the compressor 14 of the air conditioner distributed to the compressor 14. The pressure reducing valve control portion 86 acquires a target discharge flow rate Qt of the main pump 34 which realizes the target horsepower of the main pump 34 at the detected total hydraulic pressure P acquired by the hydraulic pressure acquiring portion 88, and controls the control current A supplied to the pressure reducing valve 62 such that the discharge flow rate Q of the main pump 34 is made to be the target discharge flow rate $Q_t$ at the detected total hydraulic pressure P. The pressure reducing valve 62 adjusts a pilot hydraulic pressure $P_c$ supplied to the pilot port 56*c* according to the supplied control current A, and thereby adjusts the inclination angle of the swash plate 44 by the pilot hydraulic pressure $P_c$ against the bias force of the bias mechanism 48 or by the bias force of the bias mechanism 48 against the hydraulic pressure of the pilot hydraulic pressure $P_c$, adjusts the discharge flow rate Q of the main pump 34, and thereby adjust the absorption horsepower of the main pump 34 to the target horsepower.

Figure 2C:
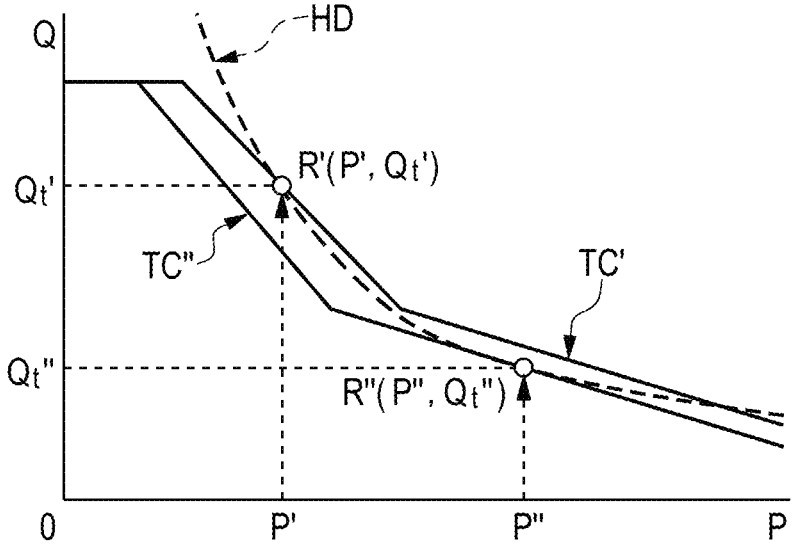

In the present embodiment, as shown in FIG. 2C, the control current A supplied to the pressure reducing valve 62 is controlled, and thereby the flow rate adjusting mechanism 42 is adjusted and the characteristic line is moved left or right. The control current A supplied to the pressure reducing valve 62 is controlled such that characteristic lines TC' and TC" intersect the target horsepower curve HD at target points R' (P', Qt') and R" (P", Qt") on the target horsepower curve HD where the discharge flow rates Q are the target discharge flow rates Qt' and Qt" with respect to given total hydraulic pressures P' and P".

Referring again to FIG. 1, the sub-pump 38 supplies a hydraulic fluid to the various types of hydraulic driving devices 16 through the third supply channel 22*c* via control valve 18. For example, the hydraulic fluid is supplied from the sub-pump 38 to a rotating motor of an upper rotating structure, a swing cylinder of a swing, and a blade cylinder of a blade.

The sub-pump 38 has a constant discharge flow rate of the discharged hydraulic fluid, and a horsepower of output from the sub pump 38 is determined by a third discharge hydraulic pressure $P_3$ of a hydraulic fluid discharged from the sub-pump 38, and the horsepower varies by variation of the third discharge hydraulic pressure $P_3$. The sub-pump 38 is also driven by the engine 12, and so the horsepower reduction is performed in the main pump 34 according to the variation of the horsepower of the output from the sub-pump 38 distributed to the sub-pump 38 within the output horsepower from the engine 12.

That is, the third discharge hydraulic pressure $P_3$ is supplied to the port 56*d* of the flow rate adjusting mechanism 42 via the channel 54*d* from the sub-pump 38. The swash plate 44 is pressed in the direction in which the inclination angle decreases, that is, the discharge flow rate Q of the main pump 34 decreases by the third discharge hydraulic pressure $P_3$ supplied to the port 56*d*. When the third discharge hydraulic pressure $P_3$ increases or decreases, the inclination angle of the swash plate 44 decreases or increases by the third discharge hydraulic pressure $P_3$ against the bias force of the bias mechanism 48 or by the bias force of the bias mechanism 48 against the hydraulic pressure of the third discharge hydraulic pressure $P_3$, the discharge flow rate Q of the main pump 34 decreases or increases, and the absorption horsepower of the main pump 34 decreases or increases.

In the present embodiment, the target horsepower to be output from the main pump 34 is further set according to the variation of the horsepower of the output from the sub-pump 38, the absorption horsepower of the main pump 34 is adjusted so as to be less than and come close to the set target horsepower, as described above.

That is, the third hydraulic pressure sensor 72*c* detects the third discharge hydraulic pressure $P_3$ of the sub-pump 38 and outputs it to the controller 82. In the controller 82, the hydraulic pressure acquiring portion 88 acquires the detected third discharge hydraulic pressure $P_3$ input from the third hydraulic pressure sensor 72*c*. The pressure reducing valve control portion 86 acquires the horsepower of the output from the sub-pump 38 based on the detected third discharge hydraulic pressure $P_3$ acquired by the hydraulic pressure acquiring portion 88, and sets a target horsepower to be output from the main pump 34 according to the horsepower of the output from the compressor 14 of the air conditioner distributed to the compressor 14 and the horsepower of the output from the sub-pump 38 distributed to the sub-pump 38, within the output horsepower from the engine 12. The hydraulic pressure acquiring portion 88 acquires a target discharge flow rate $Q_t$ of the main pump 34 which realize the target horsepower of the output from the main pump 34 at the detected total hydraulic pressure P of the first and second discharge hydraulic pressure $P_1$ and $P_2$ of the main pump 34 acquired by the hydraulic pressure acquiring portion 88, and controls the control current A supplied to the pressure reducing valve 62 such that the discharge flow rate Q of the main pump 34 is made to be the target discharge flow rate $Q_t$ at the detected total hydraulic pressure P.

In the present embodiment, the hydraulic mechanism includes the pilot pump 36, the pressure reducing valve 62, and the pilot port 56*c*, and applies the pilot hydraulic pressure Pc to the swash plate 44, and the pressure reducing valve 62 adjusts the magnitude of the pilot hydraulic pressure Pc applied to the swash plate 44, and thereby the inclination angle of the swash plate 44 is adjusted. However, an electromagnetic mechanism such as a solenoid valve may apply force to the swash plate 44, further adjust the magnitude of the force applied to the swash plate 44, and thereby adjust the inclination angle of the swash plate 44.

Figure 3:
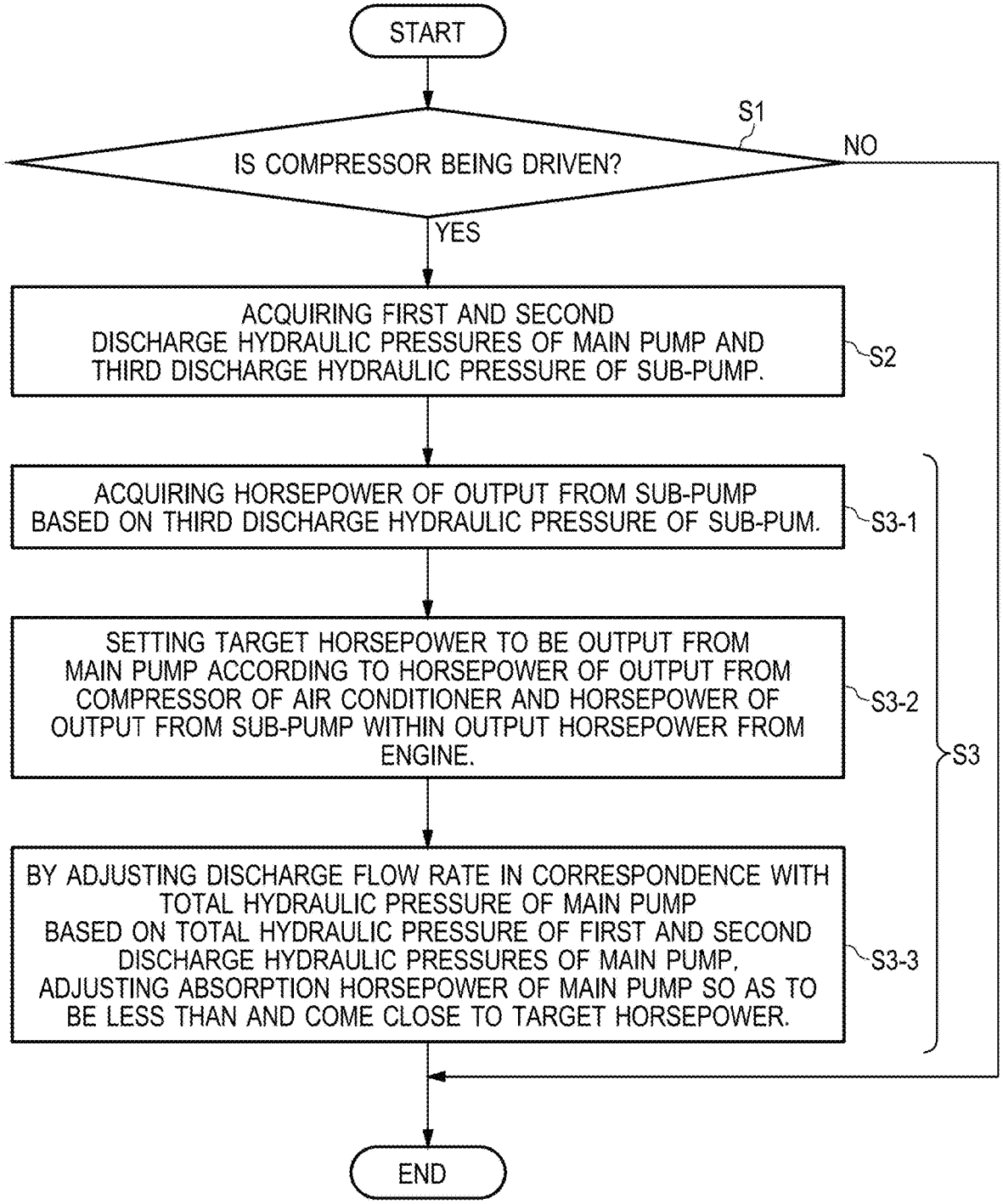
FIG. 3 is a flowchart diagram showing an output control method according to the embodiment of the present disclosure.

Referring to FIG. 3, an output control method according to the embodiment will be explained.

As shown in FIG. 3, the output control method according to the embodiment includes each of the following steps.

Driving State Detecting Step S1

In the driving state detecting step S1, it is detected whether the compressor 14 of the air conditioner of the hydraulic excavator 10 is being driven. When it is detected that the compressor 14 is being driven, the method proceeds to a hydraulic pressure acquiring step S2. When it is detected that the compressor 14 is not being driven, an adjustment of output from the main pump 34 is not performed.

Hydraulic Pressure Acquiring Step S2

In the hydraulic pressure acquiring step S2, first and second discharge hydraulic pressures $P_1$ and $P_2$ of a hydraulic fluid discharged from the main pump 34 and a third discharge hydraulic pressure $P_3$ of a hydraulic fluid discharged from the sub-pump 38 which are detected by the first to third hydraulic pressure sensors 72*a*, 72*b*, and 72*c* are acquired.

Output Control Step S3

The output control step S3 includes each of the following steps.

Horsepower Acquiring Step S3-1

In horsepower acquiring step S3-1, a horsepower of output from the sub-pump 38 is acquired based on the third discharge hydraulic pressure $P_3$ acquired by the hydraulic pressure acquiring step S2.

Target Horsepower Setting Step S3-2

In the target horsepower setting step S3-2, the target horsepower to be output from the main pump 34 is set according to a horsepower of output from the compressor 14 of the air conditioner and a horsepower of output from the sub-pump 38 within an output horsepower from the engine 12.

Output Adjusting Step S3-3

In the output adjusting step S3-3, a discharge flow rate Q in correspondence with a total hydraulic pressure P of a hydraulic fluid discharged from the main pump 34 is adjusted based on the total hydraulic pressure P of the first and second discharge hydraulic pressures P1 and P2 of the main pump 34 acquired in the hydraulic pressure acquiring step S2, and thereby an output horsepower from the main pump 34, that is, an absorption horsepower of the main pump 34 is adjusted so as to be less than and come close to the target horsepower.

Each step of the output control method in the present embodiment corresponds to each functional configuration of the hydraulic excavator 10 in the embodiment described above, and therefore, a detailed description about the output control method is omitted.

Figure 4:
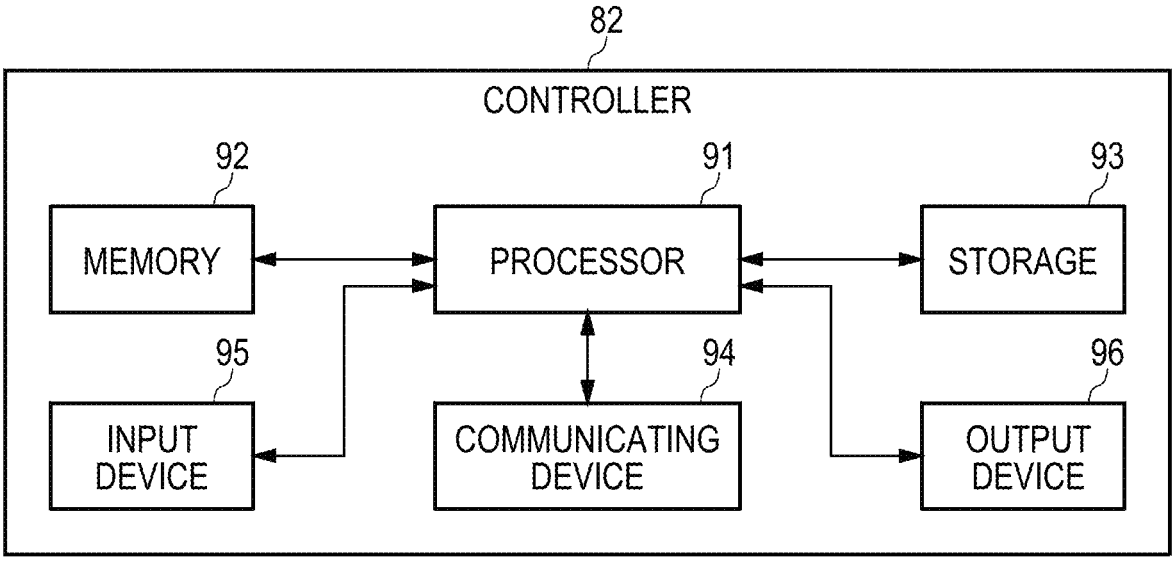
FIG. 4 is a block diagram showing a hardware configuration of a controller according to the embodiment of the present disclosure.

Referring to FIG. 4, a hardware configuration of the controller 82 according to the present embodiment will be described.

As shown in FIG. 4, the controller 82 according to the present embodiment is configured as a computer including a processor 91, memory 92, storage 93, input device 95, output device 96, communicating device 94, and buses connecting these devices. Certain programs are load onto hardware such as processor 91 and memory 92, etc., and the processor 91 performs calculations, controls communication by the communicating device 94, and reads and writes data in the memory 92 and storage 93, and thereby each function or step in the controller 82 is realized or executed. An output control program according to the present embodiment makes the computer of the controller 82 realize each function for the output control and execute each step of the output control method according to the present embodiment described above.

As described above, in the present embodiment, for the main pump 34 driven by the engine 12 configured to output with a certain horsepower, the target horsepower to be output from the main pump 34 is set within the output horsepower from the engine 12, the first and second discharge hydraulic pressures $P_1$ and $P_2$ of the main pump 34 are detected, the flow rate Q in correspondence with the total hydraulic pressure P of the hydraulic fluid discharged from the main pump 34 is adjusted based on the detected total hydraulic pressure P of the first and second discharge hydraulic pressures $P_1$ and $P_2$, and thereby the horsepower of the output from the main pump 34 is made to be less than and sufficiently come close to the target horsepower. Therefore, it is possible to effectively utilize to the maximum extent the output horsepower from the engine 12 in the main pump 34.

Moreover, for the sub-pump 38 which is configured to be driven by the engine 12 and from which the flow rate of the hydraulic fluid discharged is constant, the third discharge hydraulic pressure $P_3$ of the sub-pump 38 is detected, and the target horsepower to be output from the main pump 34 is set based on the horsepower of the output from the sub-pump 38 acquired based on the detected third discharge hydraulic pressure P3. Therefore, it is possible to effectively utilize the output horsepower from the engine 12 in the main pump 34 regardless of the variation in the horsepower of the output from the sub-pump 38.

Characteristic disclosed matters of the present application may be summarized as follows.

First disclosed matter is an output control device for adjusting output from a hydraulic fluid discharge device configured to be driven by a power source configured to output with a certain horsepower, the output control device comprising: a hydraulic pressure acquiring portion configured to acquire a hydraulic pressure detected by a hydraulic pressure detecting device configured to detect a hydraulic pressure of a hydraulic fluid discharged from the hydraulic fluid discharge device; and an output control portion configured to adjust the output from the hydraulic fluid discharge device by adjusting a flow rate of the hydraulic fluid in correspondence with the hydraulic pressure of the hydraulic fluid discharged from the hydraulic fluid discharge device based on the hydraulic pressure acquired by the hydraulic pressure acquiring portion.

In the present disclosed matter, for the hydraulic fluid discharge device driven by the power source configured to output with a certain horsepower, the hydraulic pressure of the hydraulic fluid discharged from the hydraulic fluid discharge device is detected, and the flow rate in correspondence with the hydraulic pressure of the hydraulic fluid discharged from the hydraulic fluid discharge device is adjusted based on the detected hydraulic pressure, and thereby the output from the hydraulic fluid discharge device is adjusted. Therefore, it is possible to effectively utilize the output horsepower from the power source in the hydraulic fluid discharge device.

Second disclosed matter is the output control device according to the first disclosed matter, wherein the output control portion is configured to set a target horsepower to be output from the hydraulic fluid discharge device within an output horsepower from the power source, and control the output from the hydraulic fluid discharge device so as to come close to the target horsepower.

In the present disclosed matter, the target horsepower to be output from the hydraulic fluid discharge device is set within the output horsepower from the power source, and the output from the hydraulic fluid discharge device is controlled so as to come close to the target horsepower. Therefore, it is possible to effectively utilize to the maximum extent the output horsepower from the power source in the hydraulic fluid discharge device.

Third disclosed matter is the output control device according to the second disclosed matter, wherein the output control portion is configured to move a characteristic line showing a relation between the hydraulic pressure of the hydraulic fluid and the flow rate of the hydraulic fluid in the hydraulic fluid discharge device such that the characteristic line intersects a target horsepower curve showing the target horsepower at a certain hydraulic pressure, when the hydraulic pressure of the hydraulic fluid changes.

In the present disclosed matter, when the hydraulic pressure of the hydraulic fluid discharged from the hydraulic fluid discharge device is changed, the characteristic line showing the relation between the hydraulic pressure of the hydraulic fluid and the hydraulic fluid flow rate in the hydraulic fluid discharge device is moved such that the characteristic line intersects the target horsepower curve showing the target horsepower, at a certain hydraulic pressure. Thereby, the flow rate of the hydraulic fluid discharged from the hydraulic fluid discharge device is adjusted.

Fourth disclosed matter is the output control device according to the third disclosed matter, wherein the hydraulic fluid discharge device and the hydraulic pressure detecting device are respectively a first hydraulic fluid discharge device and a first hydraulic pressure detecting device, the hydraulic pressure acquiring portion is configured to acquire, as a first hydraulic pressure, the hydraulic pressure detected by the first hydraulic pressure detecting device, and acquire, as a second hydraulic pressure, a hydraulic pressure detected by a second hydraulic pressure detecting device configured to detect a hydraulic pressure of a hydraulic fluid discharged from a second hydraulic fluid discharge device which is configured to be driven by the power source and from which a flow rate of the hydraulic fluid discharged is to be constant, and the output control portion is configured to set the target horsepower to be output from the first hydraulic fluid discharge device based on a horsepower of output from the second hydraulic fluid discharge device acquired based on the second hydraulic pressure acquired by the hydraulic pressure acquiring portion.

In the present disclosed matter, for the second hydraulic fluid discharge device which is configured to be driven by the power source and form which the flow rate of the hydraulic fluid discharged is constant, the second hydraulic pressure which is the hydraulic pressure of the hydraulic fluid discharged from the second hydraulic fluid discharge device is detected, and the target horsepower to be output from the first hydraulic fluid discharge device is set based on the horsepower of the output from the second hydraulic fluid discharge device acquired based on the detected second hydraulic pressure. Therefore, it is possible to effectively utilize the output horsepower from the power source in the first hydraulic fluid discharge device regardless of variation in the output horsepower from the second hydraulic fluid discharge device.

Fifth disclosed matter is an output control system comprising the hydraulic pressure detecting device and the output control device according to any one of the first to fourth disclosed matters, a flow rate adjusting device, and an output changing device, wherein the flow rate adjusting device includes a flow rate adjusting member and a bias mechanism configured to adjust a position of the flow rate adjusting member, the output changing device is configured to change the position of the flow rate adjusting member by changing a magnitude of force applied to the flow rate adjusting member, change the flow rate of the hydraulic fluid discharged from the hydraulic fluid discharge device, and change the output from the hydraulic fluid discharge device, and the output control portion is configured to adjust the magnitude of the force applied to the flow rate adjusting member by the output changing device by controlling the output changing device based on the hydraulic pressure acquired by the hydraulic pressure acquiring portion, and adjust the position of the flow rate adjusting member.

The present disclosed matter includes the similar advantage to that in the first disclosed matter.

Sixth disclosed matter is a work vehicle comprising the power source, the hydraulic fluid discharge device, and the output control system according to the fifth disclosed matter.

The present disclosed matter includes the similar advantage to that in the first disclosed matter.

Seventh disclosed matter is an output control method for adjusting output from a hydraulic fluid discharge device configured to be driven by a power source configured to output with a certain horsepower, the output control method comprising: a hydraulic pressure acquiring to acquire a hydraulic pressure detected by a hydraulic pressure detecting device configured to detect a hydraulic pressure of a hydraulic fluid discharged from the hydraulic fluid discharge device; and an output controlling to adjust the output from the hydraulic fluid discharge device by adjusting a flow rate of the hydraulic fluid in correspondence with the hydraulic pressure of the hydraulic fluid discharged from the hydraulic fluid discharge device based on the hydraulic pressure acquired by the hydraulic pressure acquiring portion.

The present disclosed matter includes the similar advantage to that in the first disclosed matter.

Eighth disclosed matter is a non-transitory tangible storage medium storing an output control program for adjusting output from a hydraulic fluid discharge device configured to be driven by a power source configured to output with a certain horsepower, the output control program causing a computer to execute: a hydraulic pressure acquiring to acquire a hydraulic pressure detected by a hydraulic pressure detecting device configured to detect a hydraulic pressure of a hydraulic fluid discharged from the hydraulic fluid discharge device; and an output controlling to adjust the output from the hydraulic fluid discharge device by adjusting a flow rate of the hydraulic fluid in correspondence with the hydraulic pressure of the hydraulic fluid discharged from the hydraulic fluid discharge device based on the hydraulic pressure acquired by the hydraulic pressure acquiring portion.

The present disclosed matter includes the similar advantage to that in the first disclosed matter.

The invention claimed is:

1. An output control device for adjusting output from a hydraulic fluid discharge device configured to be driven by a power source configured to output with a certain horsepower, the output control device comprising:

a hydraulic pressure acquiring portion configured to acquire a hydraulic pressure detected by a hydraulic pressure detecting device configured to detect a hydraulic pressure of a hydraulic fluid discharged from the hydraulic fluid discharge device; and an output control portion configured to adjust the output from the hydraulic fluid discharge device, when a target horsepower is changed wherein the target horsepower is a horsepower distributed to the hydraulic fluid discharge device from the power source, and is a maximum horsepower usable in the hydraulic fluid discharge device, by moving a characteristic line showing a relation between the hydraulic pressure of the hydraulic fluid and a flow rate of the hydraulic fluid in the hydraulic fluid discharge device such that the characteristic line intersects a target horsepower curve showing the target horsepower at the hydraulic pressure acquired by the hydraulic pressure acquiring portion, to adjust the flow rate of the hydraulic fluid in the hydraulic fluid discharge device.

2. The output control device according to claim 1, wherein the hydraulic fluid discharge device and the hydraulic pressure detecting device are respectively a first hydraulic fluid discharge device and a first hydraulic pressure detecting device, the hydraulic pressure acquiring portion is configured to acquire, as a first hydraulic pressure, the hydraulic pressure detected by the first hydraulic pressure detecting device, and acquire, as a second hydraulic pressure, a hydraulic pressure detected by a second hydraulic pressure detecting device configured to detect a hydraulic pressure of a hydraulic fluid discharged from a second hydraulic fluid discharge device which is configured to be driven by the power source and from which a flow rate of the hydraulic fluid discharged is to be constant, and the output control portion is configured to set the target horsepower to be output from the first hydraulic fluid discharge device based on a horsepower of output from the second hydraulic fluid discharge device acquired based on the second hydraulic pressure acquired by the hydraulic pressure acquiring portion.

3. An output control system comprising the hydraulic pressure detecting device and the output control device according to claim 1, a flow rate adjusting device, and an output changing device, wherein the flow rate adjusting device includes a flow rate adjusting member and a bias mechanism configured to adjust a position of the flow rate adjusting member, the output changing device is configured to change the position of the flow rate adjusting member by changing a magnitude of force applied to the flow rate adjusting member, change the flow rate of the hydraulic fluid discharged from the hydraulic fluid discharge device, and change the output from the hydraulic fluid discharge device, and the output control portion is configured to adjust the magnitude of the force applied to the flow rate adjusting member by the output changing device by controlling the output changing device based on the hydraulic pressure acquired by the hydraulic pressure acquiring portion, and adjust the position of the flow rate adjusting member.

4. A work vehicle comprising the power source, the hydraulic fluid discharge device, and the output control system according to claim 3.

5. An output control method for adjusting output from a hydraulic fluid discharge device configured to be driven by a power source configured to output with a certain horsepower, the output control method comprising:

acquiring a hydraulic pressure detected by a hydraulic pressure detecting device configured to detect a hydraulic pressure of a hydraulic fluid discharged from the hydraulic fluid discharge device; and adjusting the output from the hydraulic fluid discharge device, when a target horsepower is changed wherein the target horsepower is a horsepower distributed to the hydraulic fluid discharge device from the power source, and is a maximum horsepower usable in the hydraulic fluid discharge device, by moving a characteristic line showing a relation between the hydraulic pressure of the hydraulic fluid and a flow rate of the hydraulic fluid in the hydraulic fluid discharge device such that the characteristic line intersects a target horsepower curve showing the target horsepower at the hydraulic pressure acquired by the hydraulic pressure acquiring portion, to adjust the flow rate of the hydraulic fluid in the hydraulic fluid discharge device.

6. A non-transitory tangible storage medium storing an output control program for adjusting output from a hydraulic fluid discharge device configured to be driven by a power source configured to output with a certain horsepower, the output control program causing a computer to execute steps comprising:

acquiring a hydraulic pressure detected by a hydraulic pressure detecting device configured to detect a hydraulic pressure of a hydraulic fluid discharged from the hydraulic fluid discharge device; and adjusting the output from the hydraulic fluid discharge device, when a target horsepower is changed wherein the target horsepower is a horsepower distributed to the hydraulic fluid discharge device from the power source, and is a maximum horsepower usable in the hydraulic fluid discharge device, by moving a characteristic line showing a relation between the hydraulic pressure of the hydraulic fluid and a flow rate of the hydraulic fluid in the hydraulic fluid discharge device such that the characteristic line intersects a target horsepower curve showing the target horsepower at the hydraulic pressure acquired by the hydraulic pressure acquiring portion, to adjust the flow rate of the hydraulic fluid in the hydraulic fluid discharge device.

* * * * *